US010125944B2

(12) United States Patent
Matsumoto et al.

(10) Patent No.: US 10,125,944 B2
(45) Date of Patent: Nov. 13, 2018

(54) LAMP

(71) Applicant: KOITO MANUFACTURING CO., LTD., Tokyo (JP)

(72) Inventors: Hiroki Matsumoto, Shizuoka (JP); Akinori Matsumoto, Shizuoka (JP)

(73) Assignee: KOITO MANUFACTURING CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/247,301

(22) Filed: Aug. 25, 2016

(65) Prior Publication Data

US 2017/0059109 A1 Mar. 2, 2017

(30) Foreign Application Priority Data

Aug. 26, 2015 (JP) ..... 2015-167174

(51) Int. Cl.

| | |
|---|---|
| ***F21S 8/10*** | (2006.01) |
| ***F21S 41/43*** | (2018.01) |
| ***F21S 41/147*** | (2018.01) |
| ***F21S 41/29*** | (2018.01) |
| ***F21S 41/255*** | (2018.01) |

(Continued)

(52) U.S. Cl.

CPC ..... *F21S 48/145* (2013.01); *F21S 41/147* (2018.01); *F21S 41/255* (2018.01); *F21S 41/295* (2018.01); *F21S 41/321* (2018.01); *F21S 41/39* (2018.01); *F21S 41/43* (2018.01); *F21S 45/10* (2018.01); *F21S 45/43* (2018.01); *F21S 45/47* (2018.01)

(58) Field of Classification Search

None

See application file for complete search history.

(56) References Cited

U.S. PATENT DOCUMENTS 4,679,127 A 7/1987 Ernst et al.
2010/0124069 A1* 5/2010 Nomura ..... F21S 48/145 362/512

(Continued)

FOREIGN PATENT DOCUMENTS

CN 103133959 A 6/2013
CN 203857382 U 10/2014

(Continued)

OTHER PUBLICATIONS

Office Action dated Jul. 30, 2018 by the State Intellectual Property Office of P.R. China in counterpart Chinese Patent Application No. 201610730903.4.

(Continued)

*Primary Examiner* — Britt D Hanley

(74) *Attorney, Agent, or Firm* — Sughrue Mion, PLLC

(57) ABSTRACT

A lamp includes a light source, a projection lens in which light from the light source is incident on one surface and the light is emitted from the other surface, a lens holder to which the projection lens is fixed and which extends to a side opposite to the direction of the light emitted from the projection lens, and a base plate disposed on the side opposite to a side of the lens holder to which the projection lens is fixed and having an opening through which the light from the light source passes. The base plate has a light shielding portion which is provided between the projection lens and the lens holder and extends toward the projection lens, and the light shielding portion is formed by bending a portion of the base plate.

10 Claims, 6 Drawing Sheets

(51) Int. Cl.

| | |
|---|---|
| ***F21S 41/39*** | (2018.01) |
| ***F21S 41/32*** | (2018.01) |
| *F21S 45/47* | (2018.01) |
| *F21S 45/10* | (2018.01) |
| *F21S 45/43* | (2018.01) |

(56) References Cited

U.S. PATENT DOCUMENTS

| | | | | |
|---|---|---|---|---|
| 2013/0141928 | A1 | 6/2013 | Puente et al. | |
| 2014/0036524 | A1* | 2/2014 | Tajima | F21S 48/1388 362/516 |
| 2016/0363283 | A1* | 12/2016 | Yamamoto | F21S 48/125 |

FOREIGN PATENT DOCUMENTS

| | | | |
|---|---|---|---|
| JP | 2006-253098 | A | 9/2006 |
| JP | 2014-146463 | A | 8/2014 |
| KR | 10-2013-0123194 | A | 11/2013 |
| WO | 03089840 | A1 | 10/2003 |

OTHER PUBLICATIONS

French Search Report issued by the French Patent and Trademark Office in counterpart Application No. 1657923, dated Apr. 26, 2018.

* cited by examiner

LAMP

CROSS-REFERENCE TO RELATED APPLICATION

The present application claims priority from Japanese Patent Application No. 2015-167174 filed on Aug. 26, 2015, the entire content of which is incorporated herein by reference.

BACKGROUND

Technical Field

The present invention relates to a lamp.

Related Art

As a lamp, for example, there is known a lamp which includes a light source and a projection lens for transmitting light emitted from the light source to project the light to a desired place. As an example of this lamp, a vehicle lamp can be included, for example.

In the following Patent Document 1, a technique relating to a vehicle headlamp which is a type of a vehicle lamp is disclosed. The vehicle headlamp disclosed in Patent Document 1 includes a lens holder, a projection lens fixed to the lens holder, a reflector, and a light source or the like. Light from the light source is reflected in the reflector and projected to the projection lens. In this vehicle headlamp, a light emitting diode (LED) is used as the light source. When the light emitting diode is used as the light source, the amount of heat generated therefrom is reduced, as compared with a related-art light source such as a halogen lamp or a discharge lamp. As a result, the lens holder or the projection lens can be made of resin.

Patent Document 1: Japanese Patent Laid-Open Publication No. 2014-146463

When the lens holder and the projection lens are made of resin as described above, reduction in weight and manufacturing cost of the lamp is achieved.

SUMMARY

The present inventors have studied the possibility that the following phenomenon occurs. That is, the present inventors have studied the possibility that when the lamp is used in the outdoor, sunlight incident inwardly through the projection lens from the outside is condensed on a portion of the lens holder made of resin, and hence, damage of the lens holder is caused.

From the results of the above study, the present inventors have found that the damage of the lens holder due to sunlight can be suppressed when a light shielding portion for preventing sunlight from being irradiated to the lens holder is provided between the projection lens and the lens holder.

Exemplary embodiments of the invention provide a lamp in which damage of a lens holder due to sunlight is suppressed.

A lamp according to an exemplary embodiment comprises:

a light source;

a projection lens in which light from the light source is incident on one surface and the light is emitted from the other surface;

a lens holder to which the projection lens is fixed and which extends to a side opposite to the direction of the light emitted from the projection lens; and a base plate disposed on the side opposite to a side of the lens holder to which the projection lens is fixed and having an opening through which the light from the light source passes, wherein the base plate has a light shielding portion which is provided between the projection lens and the lens holder and extends toward the projection lens, and the light shielding portion is formed by bending a portion of the base plate.

When the light shielding portion is provided between the projection lens and the lens holder as described above, at least a portion of sunlight incident through the projection lens from the outside of the lamp is not irradiated to the lens holder but is irradiated to the light shielding portion. As a result, the damage of the lens holder due to sunlight is suppressed. Further, since the light shielding portion is formed by bending a portion of the base plate, an increase in manufacturing cost of the lamp is suppressed.

The lamp may further comprise:

a shade which shields a portion of the light from the light source and is fixed to a side opposite to a side of the base plate on which the projection lens is provided.

When such a shade is provided, the light emitted from the light source is controlled and thus is incident on the projection lens. Therefore, the light emitted from the projection lens can be formed in a desired light distribution pattern. Further, the relative position between the projection lens and the lens holder is fixed and the relative position between the shade and the base plate is also fixed. Therefore, when the relative position between the base plate and the lens holder is fixed, the relative position between the projection lens and the shade is precisely determined. As a result, it is easy to precisely form a desired light distribution pattern.

The shade may be molded by using a mold. As described above, the shade serves to control the light from the light source. In order to precisely form the light distribution pattern of the light emitted from the projection lens, it is required that the shape of the shade is precise. When the shade is molded by using a mold, the shade with a high-accuracy shape can be obtained. Meanwhile, the base plate and the shade may be integrally molded by using a mold. However, especially when the shade requiring precision is molded by using a mold and the base plate is formed from a sheet metal or the like, an increase in manufacturing cost of the lamp is suppressed.

A fixation portion at which the shade and the base plate are fixed to each other may be located in a direction perpendicular to a bending line created when the light shielding portion is formed by bending a portion of the base plate. Since the light shielding portion is formed by bending a portion of the base plate, in the direction perpendicular to the bending line created at the time of forming the light shielding portion, bending rigidity in the direction parallel to the bending line is increased. Therefore, since the shade and the base plate are fixed to each other at the position as described above, deformation of the base plate is suppressed by a force applied to the base plate when the shade and the base plate are fixed to each other. As a result, a positional deviation of the shade is suppressed.

The shade may have an irradiation portion to which the light emitted from the light source is irradiated by being reflected in the projection lens, and the irradiation portion prevents at least a portion of the light irradiated by being reflected in the projection lens from reaching the projection lens again.

When the light emitted from the light source is irradiated to the shade by being reflected in the projection lens, and then, is again transmitted through the projection lens by being reflected in the shade, there is a possibility that light is irradiated to an unintended place. As described above, since it is prevented that at least a portion of the light irradiated to the shade again reaches the projection lens, unintended light is suppressed from being emitted from the projection lens.

The irradiation portion may extend in a direction in which at least a portion of the light irradiated by being reflected in the projection lens is reflected so as not to reach the projection lens again. Since it is easy to manufacture the shade having such a shape, it is possible to suppress unintended light from being emitted from the projection lens while suppressing an increase in manufacturing cost of the lamp.

As described above, according to the present invention, there is provided a lamp in which damage of a lens holder due to sunlight is suppressed.

DETAILED DESCRIPTION

Hereinafter, the exemplary embodiment of a lamp according to the present invention will be described in detail with reference to the drawings. Meanwhile, scale or dimension ratios or the like of respective members in each drawing may be different from the actual.

Figure 1:
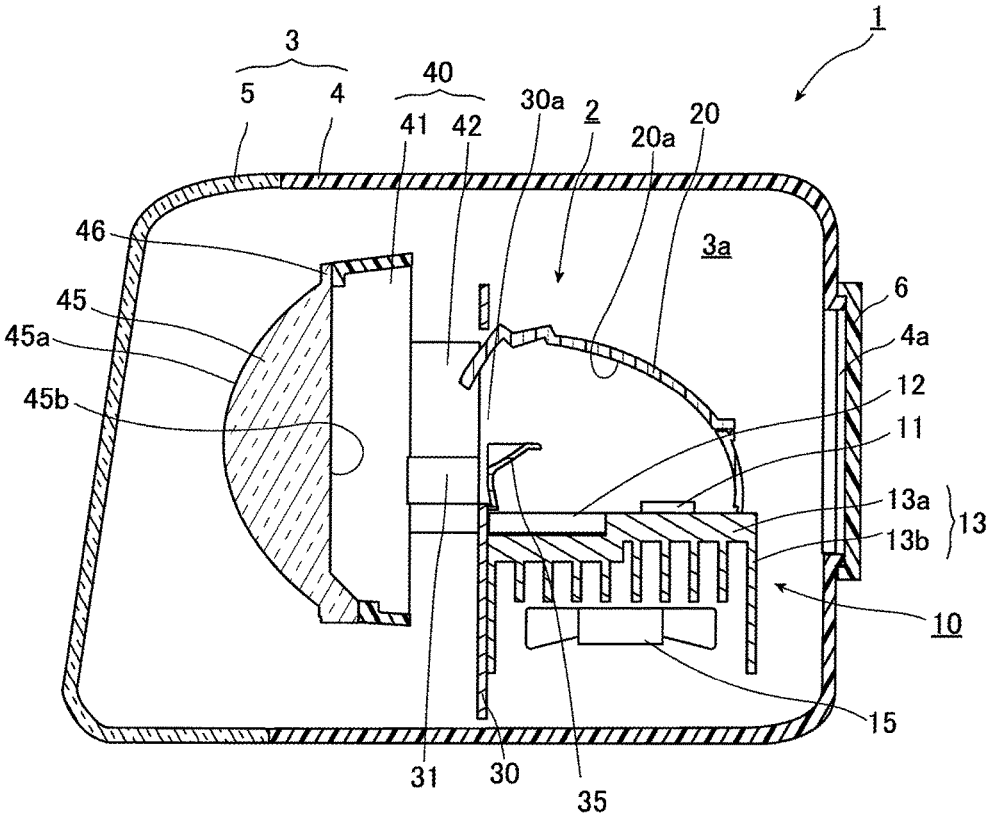
FIG. 1 is a sectional view schematically showing a configuration of a lamp according to an embodiment of the present invention.

FIG. 1 is a sectional view schematically showing a configuration of a lamp according to an embodiment of the present invention. A vehicle headlamp as an example of the lamp is shown in FIG. 1. A vehicle headlamp 1 shown in FIG. 1 includes a lamp unit 2 and an outer casing 3 for accommodating the lamp unit 2. Hereinafter, these components constituting the vehicle headlamp 1 will be described in detail.

<Outer Casing 3>

The outer casing 3 has a lamp housing 4 and a front cover 5. A lamp unit 2 is accommodated in a lamp chamber 3*a* which is defined by the lamp housing 4 and the front cover 5. The lamp housing 4 has an opening on the side toward which light from a light source 11 is emitted (to be described later). The front cover 5 is disposed so as to close the opening of the lamp housing 4. The front cover 5 is made of a translucent material and the light emitted from the light source 11 is transmitted through the front cover 5. Further, the lamp housing 4 has an opening 4*a*. The opening 4*a* is used at the time of replacing the components of the lamp unit 2. Then, the outer casing 3 further includes a back cover 6 to close the opening 4*a* of the lamp housing 4.

<Lamp Unit 2>

Figure 2:
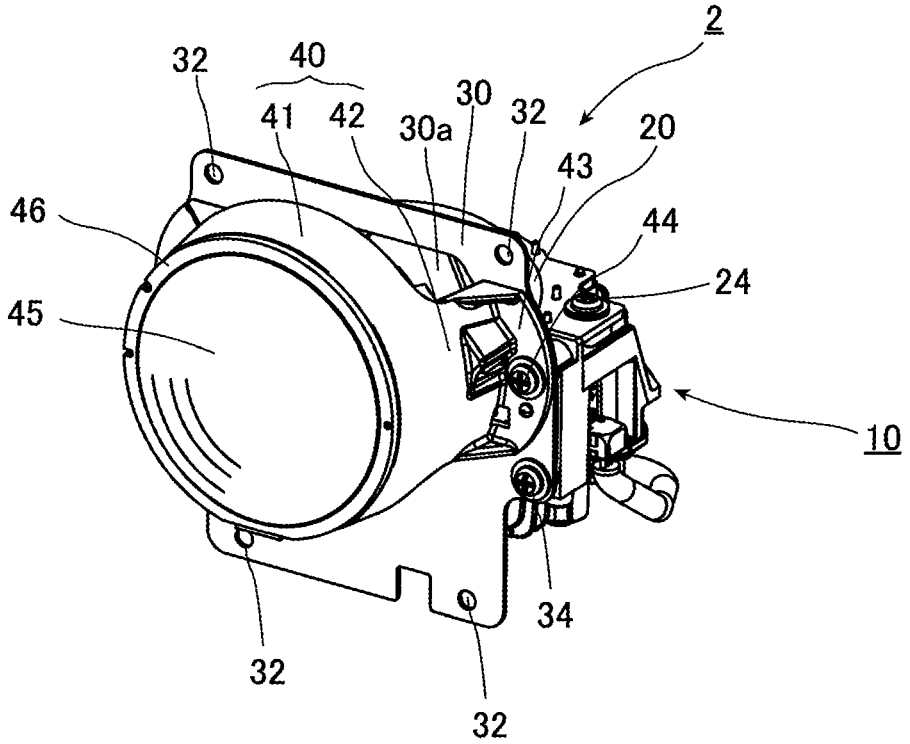
FIG. 2 is a perspective view showing a lamp unit.
Figure 3:
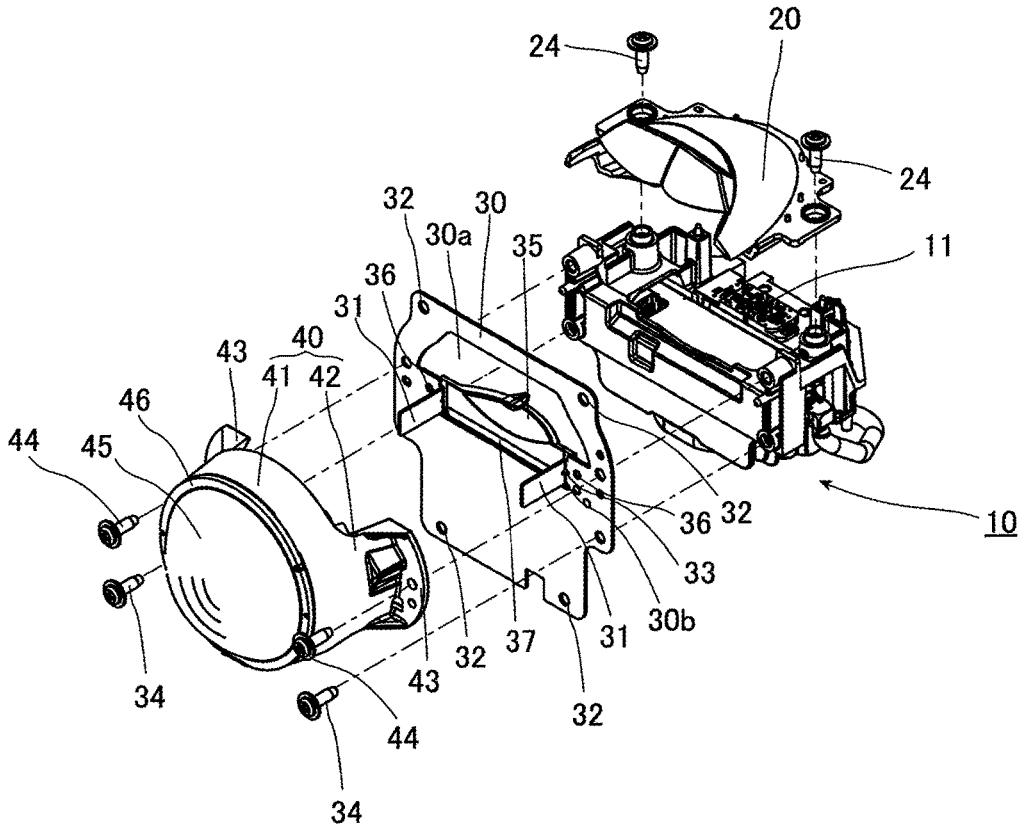
FIG. 3 is an exploded perspective view showing members constituting the lamp unit.

FIG. 2 is a perspective view showing the lamp unit 2. Further, FIG. 3 is an exploded perspective view showing members constituting the lamp unit 2. As shown in FIGS. 1 to 3, the lamp unit 2 includes, as main components, a light source unit 10, a reflector 20, a base plate 30, a shade 35, a lens holder 40 and a projection lens 45.

<Light Source Unit 10>

The light source unit 10 includes the light source 11, an emission control circuit 12, a heat sink 13 and a cooling fan 15. In the vehicle headlamp 1 of the present embodiment, the light source 11 is an LED. The emission control circuit 12 controls the light emission of the light source 11. The heat sink 13 has a base 13*a* and a plurality of heat-radiation fins 13*b*. The base 13*a* is a plate-shaped member. The light source 11 and the emission control circuit 12 are provided on one side of the base 13*a* and the heat-radiation fins 13*b* are provided on the other side of the base 13*a*. Further, the cooling fan 15 is disposed on the side where the heat-radiation fins 13*b* of the heat sink 13 are provided. Heat emitted from the light source 11 and the emission control circuit 12 is transmitted to the heat-radiation fins 13*b* from the base 13*a* of the heat sink 13. The heat-radiation fins 13*b* are cooled by the cooling fan 15. In this way, the heat is effectively emitted from the light source unit 10.

<Reflector 20>

The reflector 20 is provided so as to cover the light source 11 and is fixed to the light source unit 10 by screws 24. Further, the reflector 20 has a reflective surface 20*a* on the side facing the light source 11. The reflective surface 20*a* is a substantially ellipsoidal curved surface in which the light emission center of the light source 11 is a first focal point. At least a portion of the light emitted from the light source 11 is reflected toward the projection lens 45 by the reflective surface 20*a*.

<Projection Lens 45>

The light emitted from the light source 11 is reflected by the reflective surface 20*a*, as described above. Then, the light is incident on one surface 45*b* of the projection lens 45 and is emitted from the other surface 45*a* thereof. The projection lens 45 is an aspherical plano-convex lens. The incident surface 45*b* on which the light from the light source 11 is incident has a planar shape, and the emitting surface 45*a* from which the light from the light source 11 is emitted has a convex-surface shape bulging in an emission direction of the light. Further, the projection lens 45 has a flange portion 46 at its outer periphery. Then, the projection lens 45 projects, as an inverted image, a light source image formed on a rear focal plane that is a focal plane having a rear focal point. Therefore, when the shade 35 (to be described later) is disposed on the rear focal plane, the light of the light distribution pattern corresponding to the shape of the shade 35 is emitted from the projection lens 45.

<Lens Holder 40>

The lens holder 40 is a member for holding the projection lens 45. The flange portion 46 of the projection lens 45 is fixed to the lens holder 40. As described above, the light source 11 is an LED, and thus, the amount of heat generated from the light source 11 is reduced, as compared with a halogen lamp or a discharge lamp or the like. Therefore, the projection lens 45 and the lens holder 40 can be made of resin such as polycarbonate. In the vehicle headlamp 1 of the present embodiment, the projection lens 45 and the lens holder 40 are made of resin. When the projection lens 45 and the lens holder 40 are made of resin, the projection lens 45 and the lens holder 40 can be fixed by a welding. Further, when the projection lens 45 and the lens holder 40 are made of resin, it is possible to reduce the weight of the vehicle headlamp 1 and to reduce the manufacturing cost thereof.

The lens holder 40 has a cylindrical portion 41 provided on the projection lens 45 side and a pair of leg portions 42 provided on the light source 11 side. The pair of leg portions 42 is arranged side by side in a horizontal direction. Only one of the pair of leg portions 42 is shown in FIGS. 1 to 3. The cylindrical portion 41 is a hollow member having a truncated cone-shaped appearance. The cylindrical portion 41 extends in such a way that an inner diameter and an outer diameter are spread toward the side opposite to the direction of the light emitted from the projection lens 45. An end portion of the cylindrical portion 41 on the projection lens 45 side is welded to the flange portion 46 of the projection lens 45, as described above. Further, the pair of leg portions 42 is a portion which is formed continuously with the cylindrical portion 41. The pair of leg portions 42 extends in such a way that an interval between the leg portions 42 becomes wider toward the side opposite to the direction of the light emitted from the projection lens 45. A flange portion 43 is formed at an end portion of each of the pair of leg portions 42. The flange portions 43 are fixed to the light source unit 10 by screws 44.

<Base Plate 30 and Shade 35>

Figure 4:
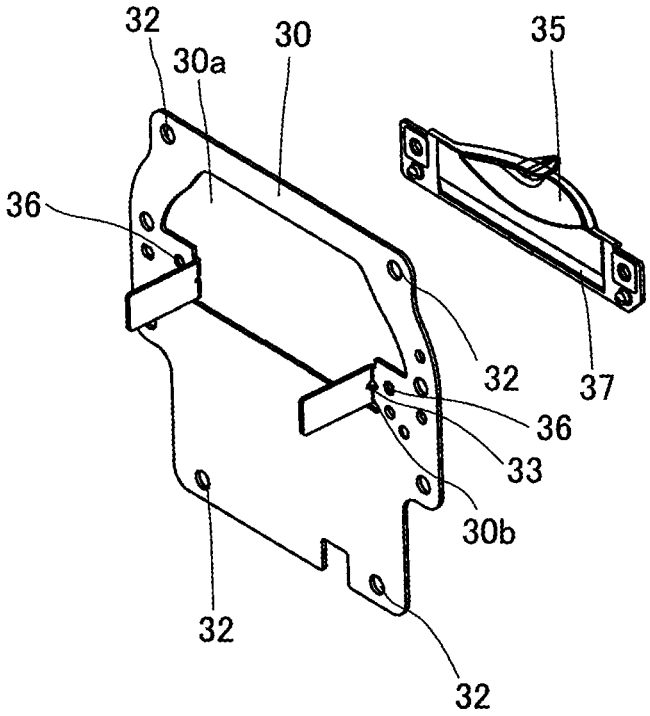
FIG. 4 is an exploded perspective view showing a base plate and a shade.
Figure 5:
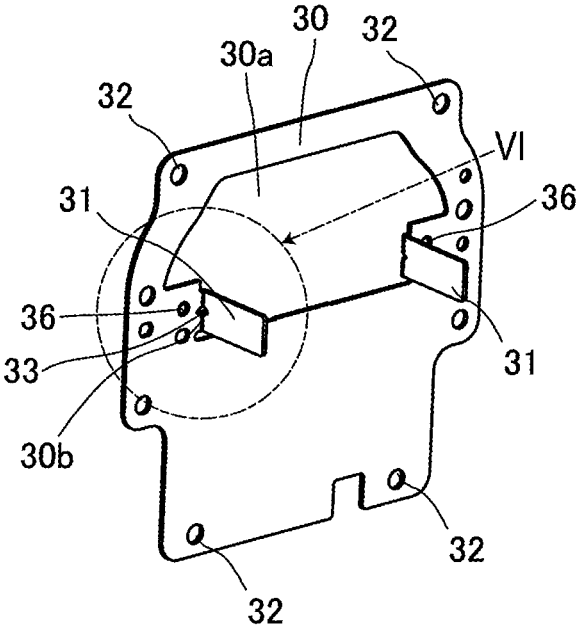
FIG. 5 is a perspective view of the base plate, as seen from a direction different from FIG. 4.
Figure 6:
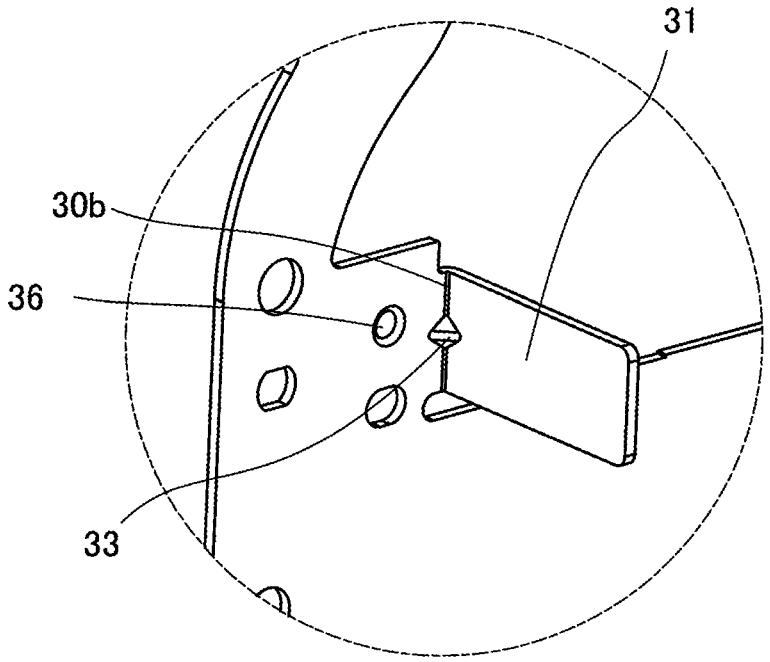
FIG. 6 is an enlarged perspective view showing a VI portion of the base plate shown in FIG. 5.

FIG. 4 is an exploded perspective view showing the base plate 30 and the shade 35. FIG. 5 is a perspective view of the base plate 30, as seen from a direction different from FIG. 4. FIG. 6 is an enlarged perspective view showing a VI portion of the base plate 30 shown in FIG. 5.

The base plate 30 is fixed to the light source unit 10 by screws 34, 44 and disposed between the lens holder 40 and the light source unit 10. That is, the base plate 30 is disposed on the side opposite to the side of the lens holder 40 to which the projection lens 45 is fixed.

The base plate 30 has an opening 30*a* through which the light emitted from the light source 11 passes. The light emitted from the light source 11 passes through the opening 30*a* of the base plate 30, and then, is incident on the projection lens 45.

Further, the base plate 30 has a plate-shaped light shielding portion 31 which is formed by bending a portion of the base plate 30. The light shielding portion 31 is provided between the projection lens 45 and the lens holder 40 (in other words, the light shielding portion 31 is positioned in a space defined by the incident surface 45*b* of the projection lens 45 and an inner surface of the lens holder 40) and extends toward the projection lens 45. More specifically, two light shielding portions 31 are arranged side by side in the horizontal direction. Each of the light shielding portions 31 is provided between each of the pair of leg portions 42 of the lens holder 40 and the projection lens 45 (in other words, each of the light shielding portions 31 is positioned in a space defined by and an inner surface of each of the pair of leg portions 42 of the lens holder 40 and the incident surface 45*b* of the projection lens 45) and extends toward the projection lens 45. When the light shielding portions 31 are provided in this manner, at least a portion of sunlight incident through the projection lens 45 from the outside of the vehicle headlamp 1 is not irradiated to the leg portions 42 of the lens holder 40 but is irradiated to the light shielding portions 31. As a result, damage of the lens holder 40 due to sunlight is suppressed. For example, even when a focal point of sunlight incident through the projection lens 45 is formed on the lens holder 40, the light shielding portions 31 prevent sunlight from being irradiated to the focal point, thereby suppressing damage of the lens holder 40.

Further, the light shielding portions 31 are formed not by attaching a separate member to the baser plate 30 but by bending a portion of the base plate 30. Therefore, an increase in manufacturing cost of the vehicle headlamp 1 is suppressed.

Meanwhile, the light shielding portions 31 are spaced apart from the lens holder 40. When the light shielding portions 31 and the lens holder 40 are spaced apart from each other, heat applied to the light shielding portions 31 from sunlight is hardly transmitted to the lens holder 40. Accordingly, the lens holder 40 is more easily suppressed from being damaged by heat.

The light shielding portions 31 can be configured such that sunlight incident inwardly from the outside of the lamp unit 2 through the projection lens 45 is suppressed from being irradiated to the lens holder 40. For example, the light shielding portions 31 may be formed by bending a portion of the base plate 30 to a right angle or may be formed along the inner surface of the leg portions 42 of the lens holder 40.

Further, the base plate 30 has a mounting portion 32 for mounting the lamp unit 2 on the lamp housing 4. The mounting portion 32 is a through-hole formed at a position in which the base plate 30 is not overlapped with other members constituting the lamp unit 2, when looking at the lamp unit 2 from the projection lens 45 side. As a screw (not shown) passing through the mounting portion 32 is screwed into a screw hole (not shown) formed in the lamp housing 4, the base plate 30 is fixed by being held between a head portion of the screw and the lamp housing 4, and hence, the lamp unit 2 is fixed to the lamp housing 4.

Material constituting the base plate 30 is not particularly limited. However, since the base plate 30 is provided with the light-shielding portions 31 to receive sunlight, the base plate 30 is preferably made of a heat-resistant material such as a metal.

Next, the shade 35 is described. The shade 35 is a member for shielding a portion of light from the light source 11. The shade 35 is fixed to the side of the base plate 30 opposite to the side on which the projection lens 45 is disposed. The light emitted from the light source 11 is incident on the projection lens 45 by being controlled by the shade 35. In this way, the light emitted from the projection lens 45 can be formed in a desired light distribution pattern. The light emitted from the light source 11 is reflected by the reflector 20 and a portion thereof is irradiated to the shade 35. A portion of the light irradiated to the shade 35 is not incident on the projection lens 45 by being shielded by the shade 35. Further, some other portion of the light irradiated to the shade 35 is incident on the projection lens 45 by being reflected by the shade 35. At this time, when the shade 35 has a shape tailored for a desired light distribution pattern, a desired cut line is formed or an overhead sign is formed. In this way, the light is incident on the projection lens 45 so as to form a desired light distribution pattern. As a result, various light distribution patterns can be formed just by suitably changing the shape of the shade 35.

As described above, the shade 35 serves to control the light which is emitted from the light source 11 and is incident on the projection lens 45. In order to precisely form the light distribution pattern of the light emitted from the projection lens 45, it is preferable that the shape of the shade 35 is precise. Therefore, the shade 35 is preferably molded by using a mold. Especially, the shade 35 is preferably molded by an aluminum die-casting. When the shade 35 is molded by using a mold, the shade 35 with a high-accuracy shape can be obtained. Meanwhile, the base plate 30 and the shade 35 may be integrally molded by using a mold.

However, especially when the shade 35 requiring precision is molded by using a mold and the base plate 30 is formed from a sheet metal or the like, an increase in manufacturing cost of the vehicle headlamp 1 is suppressed.

As described above, the projection lens 45 and the lens holder 40 are fixed to each other, and the shade 35 and the base plate 30 are also fixed to each other. Further, the base plate 30 is fixed by being held between the lens holder 40 and the light source unit 10. Therefore, the base plate 30 and the lens holder 40 are also fixed to each other, and hence, a relative position between the projection lens 45 and the shade 35 is precisely determined. Furthermore, the base plate 30 and the reflector 20 are fixed to the light source unit 10. Therefore, a relative position among the light source 11, the reflector 20, the shade 35 and the projection lens 45 is also precisely determined. Thereby, according to the vehicle headlamp 1 of the present embodiment, the light incident on the projection lens 45 via the shade 35 from the light source 11 easily moves along a desired path and it is easy to precisely form a desired light distribution pattern.

A method of fixing the shade 35 and the base plate 30 to each other is not particularly limited. For example, the shade 35 and the base plate 30 are fixed by caulking or screwing. A fixation portion 36 at which the shade 35 and the base plate 30 are fixed to each other is positioned in the direction perpendicular to a bending line 30*b* created when the light shielding portion 31 is formed by bending a portion of the base plate 30. Since the light shielding portion 31 is formed by bending a portion of the base plate 30, in the direction perpendicular to the bending line 30*b* created at the time of forming the light shielding portion, bending rigidity in the direction parallel to the bending line 30*b* is increased. Therefore, since the shade 35 and the base plate 30 are fixed to each other at the position as described above, deformation of the base plate 30 is suppressed by a force applied to the base plate 30 when the shade 35 and the base plate 30 are fixed to each other. Since the deformation of the base plate 30 is suppressed, a positional deviation of the shade 35 is suppressed. Therefore, a desired light distribution pattern can be more easily and precisely formed by the shade 35.

Meanwhile, in the vehicle headlamp 1 of the present embodiment, a bead 33 is formed at an origin of the light shielding portion 31, that is, at a position in which the bending line 30*b* is formed. When the bead 33 is formed in this way, the deformation of the base plate 30 is more easily suppressed when the shade 35 and the base plate 30 are fixed to each other. Therefore, the positional deviation of the shade 35 is more easily suppressed and a desired light distribution pattern can be more easily and precisely formed by the shade 35.

Figure 7:
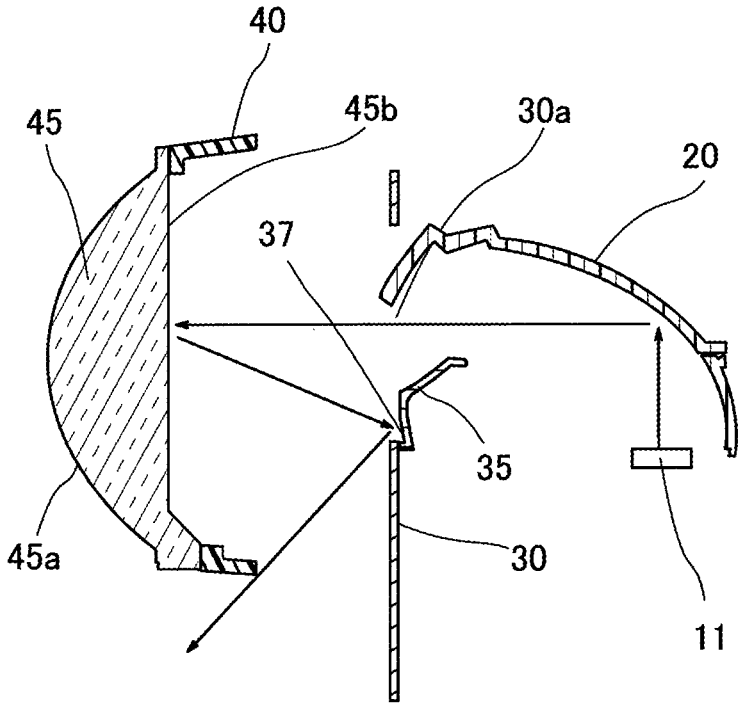
FIG. 7 is a view showing a cross section of some members constituting the lamp unit and an example of an optical path of light emitted from a light source.
Figure 8:
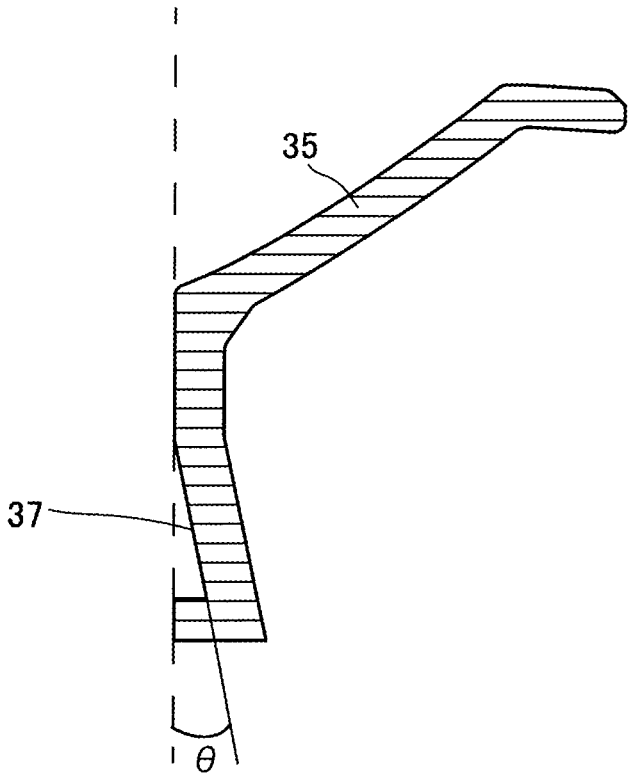
FIG. 8 is a view showing a cross section of the shade.

Further, the shade 35 has an irradiation portion 37 to which the light emitted from the light source 11 is irradiated by being reflected in the projection lens 45. Now, the irradiation portion 37 is described with reference to FIGS. 7 and 8. FIG. 7 is a view showing a cross section of some members constituting the lamp unit 2 and an example of an optical path of light emitted from the light source 11. An example of the optical path is indicated by an arrow in FIG. 7. Further, FIG. 8 is a view showing a cross section of the shade 35.

Most of light, which is emitted from the light source 11 and reaches the incident surface 45*b* of the projection lens 45 by being reflected in the reflector 20, is emitted from the emitting surface 45*a*. But, as shown in FIG. 7, a portion of the light, which is emitted from the light source 11 and reaches the incident surface 45*b* of the projection lens 45 by being reflected in the reflector 20, may be reflected toward the shade 35 by the incident surface 45*b*. The portion of the light reflected by the incident surface 45*b* in this way is irradiated to the irradiation portion 37 of the shade 35. The irradiation portion 37 is configured such that at least a portion of the light irradiated by being reflected in the incident surface 45*b* is prevented from reaching the projection lens 45 again. Specifically, the irradiation portion 37 is formed to be inclined at a predetermined angle θ with respect to the incident surface 45*b*. A broken line shown in FIG. 8 represents a plane parallel to the incident surface 45*b*. When the irradiation portion 37 is formed to be inclined in this way, at least a portion of the light irradiated to the irradiation portion 37 by being reflected in the projection lens 45 is reflected in a direction in which the light is not incident on the projection lens 45. The inclination angle θ of the irradiation portion 37 to the incident surface 45*b* can be properly changed depending on a positional relationship between the projection lens 45 and the irradiation portion 37, or the like. For example, the inclination angle θ can be about 10°.

When the light emitted from the light source 11 is irradiated to the shade 35 by being reflected in the projection lens 45, and then, is again transmitted through the projection lens 45 by being reflected in the shade 35, there is a possibility that light is irradiated to an unintended place. As described above, since it is prevented that at least a portion of the light irradiated to the shade 35 again reaches the projection lens 45, unintended light is suppressed from being emitted from the projection lens 45. Further, it is easy to manufacture the shade 37 which has the irradiation portion 37 inclined in the predetermined angle θ with respect to the incident surface 45*b*. Therefore, according to the vehicle headlamp 1 of the present embodiment, it is possible to suppress unintended light from being emitted from the projection lens 45 while suppressing an increase in manufacturing cost.

Hereinabove, an exemplary embodiment of the present invention has been described as an example. However, the present invention is not limited to this configuration. For example, the configuration of the light shielding portion is not limited to the above example. The light shielding portion may be formed by bending a portion of the base plate and may be configured to suppress sunlight from being irradiated to the lens holder. Therefore, the shape, size and installation position of the light shielding portion can be properly changed depending on the shape or the like of the lens holder.

Further, in the vehicle headlamp 1 of the above embodiment, an example where the shade 35 is fixed to the base plate 30 has been described. However, the lamp of the present invention is not limited to such an example. The shade can be disposed at a position capable of controlling the light distribution pattern of light which is emitted from the light source and then is emitted from the projection lens via the shade. The shade may not be fixed to the base plate.

Further, in the vehicle headlamp 1 of the above embodiment, an example where the shade 35 is molded by using a mold has been described. However, a method of manufacturing the shade is not particularly limited. Since the shape of the shade is precise when the shade is molded by using a mold as described above, it is desirable that the shade is molded by using a mold.

Further, in the vehicle headlamp 1 of the above embodiment, as an example, the fixation portion 36 at which the shade 35 and the base plate 30 are fixed to each other is located in a direction perpendicular to the bending line 30*b*. However, the position at which the shade and the base plate are fixed to each other is not particularly limited. In the case where the fixation portion 36 is located in the direction perpendicular to the bending line 30*b* as described above, the deformation of the base plate 30 is suppressed when the shade 35 is fixed to the base plate 30.

Further, the configuration of the irradiation portion of the shade is not limited to the example described above. The irradiation portion may be configured such that at least a portion of the light irradiated by being reflected in the projection lens is prevented from reaching the projection lens again. That is, the irradiation portion may extend in the direction in which at least a portion of the light irradiated by being reflected in the projection lens is reflected so as not to reach the projection lens again. The irradiation portion may be configured such that an inclination direction or an inclination angle is changed in the middle. Further, the irradiation portion may have a shape (such as a knurled shape) to irregularly reflect the light irradiated or may be painted in a color to absorb light.

Further, the material constituting the projection lens and the lens holder is not limited to resin. However, in the case where the lens holder is made of resin or the like, which is weak to heat, the effect of the present invention, i.e., the effect of suppressing damage of the lens holder due to sunlight can be more remarkably obtained. Further, when the projection lens is also made of resin, the projection lens can be easily fixed, by welding, to the lens holder made of resin.

Further, the lamp of the present invention is not limited to the vehicle headlamp. However, since an object of the present invention is to suppress damage of the lens holder due to sunlight, the lamp of the present invention may be used in the outdoor. Therefore, the lamp of the present invention is preferably applied to the lamp such as the vehicle headlamp, which is used in the outdoor where sunlight is irradiated. As an example other than the vehicle headlamp, a projector or the like can be exemplified.

According to the present invention, there is provided a lamp in which damage of a lens holder due to sunlight is suppressed. The lamp is suitably used for a lamp used in the outdoor, such as a vehicle headlamp.

What is claimed is:

1. A lamp comprising:

a light source;

a projection lens in which light from the light source is incident on one surface and the light is emitted from the other surface;

a lens holder to which the projection lens is fixed and which extends to a side opposite to a direction of the light emitted from the projection lens; and a base plate disposed on the side opposite to a side of the lens holder to which the projection lens is fixed and having an opening through which the light from the light source passes, wherein the base plate has a light shielding portion, and the light shielding portion comprises two bent portions that are connected to the base plate and spaced apart from each other, and wherein the bent portions are interposed between the projection lens and the lens holder, and extend toward the projection lens such that the bent portions overlap the lens holder, and wherein the bent portions prevent external light that enters the projection lens from outside the lamp from being incident upon the lens holder.

2. The lamp according to claim 1, further comprising:

a shade which shields a portion of the light from the light source and is fixed to a side opposite to a side of the base plate on which the projection lens is provided.

3. The lamp according to claim 2, wherein the shade is molded by using a mold.

4. The lamp according to claim 2, wherein a fixation portion at which the shade and the base plate are fixed to each other is located in a direction perpendicular to a bending line created when the light shielding portion is formed by bending a portion of the base plate.

5. The lamp according to claim 2, wherein the shade has an irradiation portion to which the light emitted from the light source is irradiated by being reflected from the projection lens, and the irradiation portion reflects the light again so as to prevent at least a portion of the light reflected from the projection lens from reaching the projection lens again.

6. The lamp according to claim 5, wherein the irradiation portion extends at a predetermined slanted angle with respect to the surface of the projection lens on which light is incident.

7. The lamp according to claim 1, wherein the light shielding portion is bent from a portion of the base plate at a right angle.

8. The lamp according to claim 1, wherein the lens holder has a cylindrical shape and the light shielding portion is formed along an inner surface of the lens holder.

9. The lamp according to claim 1, wherein the lens holder includes a pair of leg portions, and each of the two bent portions of the light shielding portion is provided between the pair of leg portions of the lens holder and the projection lens.

10. The lamp according to claim 1, wherein the lens holder includes a pair of leg portions, and each of the two bent portions of the light shielding portion is formed along an inner surface of a leg portion of the pair of leg portions of the lens holder.

* * * * *